US005868874A

United States Patent [19]

Rossio

[11] Patent Number: 5,868,874

[45] Date of Patent: Feb. 9, 1999

[54] ZINC PHOSPHATE CONVERSION COATING COMPOSITIONS AND PROCESS

[75] Inventor: Charles E. Rossio, Carleton, Mich.

[73] Assignee: PPG Industries, Inc., Pittsburgh, Pa.

[21] Appl. No.: 12,247

[22] Filed: Jan. 23, 1998

Related U.S. Application Data

[62] Division of Ser. No. 572,434, Dec. 14, 1995, Pat. No. 5,797,987.

[51] Int. Cl.[6] ..... C23C 22/07; C09D 5/08

[52] U.S. Cl. ..... 148/262; 106/14.12; 106/14.21; 106/14.44; 148/253; 148/259; 148/261; 148/263; 427/422; 427/430.1; 427/431; 427/435; 428/469; 428/472; 428/472.2; 428/472.3

[58] Field of Search ..... 106/14.12, 14.44, 106/14.21; 148/253, 259, 261, 262, 263; 427/422, 430.1, 431, 435; 428/469, 472, 472.2, 472.3

[56] References Cited

U.S. PATENT DOCUMENTS

| | | | |
|---|---|---|---|
| 2,487,137 | 11/1949 | Hoover et al. | 148/6.15 |
| 2,743,204 | 4/1956 | Russell | 148/6.15 |
| 2,874,081 | 2/1959 | Cavanagh et al. | 148/6.15 |
| 2,884,351 | 4/1959 | Cavanagh et al. | 148/6.15 |
| 3,310,239 | 3/1967 | Hesp et al. | 239/169 |
| 3,450,579 | 6/1969 | Rausch et al. | 148/6.16 |
| 4,180,406 | 12/1979 | Miyazaki et al. | 106/14.15 |
| 4,419,199 | 12/1983 | Hauffe et al. | 204/181 R |
| 4,443,273 | 4/1984 | Saito et al. | 148/6.15 Z |
| 4,457,790 | 7/1984 | Lindert et al. | 148/6.15 R |
| 4,486,241 | 12/1984 | Donofrio | 148/6.15 Z |
| 4,865,653 | 9/1989 | Kramer | 204/38.1 |
| 4,983,229 | 1/1991 | Tull | 148/246 |
| 5,203,930 | 4/1993 | Blumlhuber et al. | 148/262 |
| 5,236,565 | 8/1993 | Müller et al. | 204/181.3 |
| 5,238,506 | 8/1993 | Cape et al. | 148/262 |
| 5,391,239 | 2/1995 | Boulos | 148/253 |
| 5,401,381 | 3/1995 | Seidel et al. | 205/177 |

FOREIGN PATENT DOCUMENTS

| | | |
|---|---|---|
| 2022728 | 8/1989 | Canada . |
| 0287133 | 10/1988 | European Pat. Off. . |
| 0304108 | 2/1989 | European Pat. Off. . |
| 1172741 | 10/1958 | France . |
| 2204067 | 11/1988 | United Kingdom . |
| 2208876 | 4/1989 | United Kingdom . |
| 2226829 | 7/1990 | United Kingdom . |
| WO96/16204 | 5/1996 | WIPO . |
| WO97/21850 | 6/1997 | WIPO . |

OTHER PUBLICATIONS

Phosphating of Metals, (1974) by Guy Lorin, Finishing Publications Ltd., pp. 84–85. No Month.

*Primary Examiner*—Anthony Green
*Attorney, Agent, or Firm*—Kenneth J. Stachel; Krisanne Shideler

[57] ABSTRACT

A process for forming a zinc phosphate coating on an aluminum substrate is provided to obtain good coverage by the coating. The coating preferably has a columnar or nodular crystal morphology and a coating weight of at least about 150 mg/ft$^2$. The aluminum substrate is contacted with a zinc phosphate conversion coating bath which contains: (a) from about 0.4 to 2.5 g/l zinc ion; (b) from about 5 to 26 g/l phosphate ion; (c) from about 0.4 to 1.5 g/l fluoride ion; (d) from about 4 to 400 mg/l ferrous ion; and (e) from about 0.01 to 2 g/l ammonium ion. The zinc phosphate conversion coating is formable on an aluminum substrate in the presence or absence of an accelerator. Also provided is an aqueous zinc phosphate conversion coating concentrate which contains: (a) from about 10 to 60 g/l zinc ion; (b) from about 160 to 400 g/l phosphate ion; (c) from about 2 to 40 g/l fluoride ion; (d) from about 0.2 to 2.0 g/l ferrous ion; and (e) from about 1.0 to 25 g/l ammonium ion. The concentrate may be diluted with an aqueous medium in a weight ratio of about 1:10 to 1:100 to yield a zinc phosphate conversion coating bath.

12 Claims, No Drawings

ZINC PHOSPHATE CONVERSION COATING COMPOSITIONS AND PROCESS

This is a divisional of U.S. patent application Ser. No. 08/572,434, filed Dec. 14, 1995 now U.S. Pat. No. 5,797, 987.

The present invention relates to zinc phosphate conversion coatings and to a process for forming a zinc phosphate coating on a metal substrate, particularly an aluminum substrate.

It has long been known that the formation of a zinc phosphate coating, also known as a zinc phosphate conversion coating, on a metal substrate is beneficial in providing corrosion resistance and also in enhancing the adhesion of paint to the coated metal substrate. Zinc phosphate coatings are useful on a variety of metal substrates including aluminum, steel, and substrates which comprise more than one metal, such as automobile bodies or parts, which typically include steel, aluminum, zinc and their alloys. The zinc phosphate coatings may be applied to the metal substrate by dipping the metal substrate in the zinc phosphate coating composition, spraying the composition onto the metal substrate, or using various combinations of dipping and spraying. It is important that the coating be applied completely and evenly over the surface of the substrate and that the coating application not be time or labor intensive. In addition, proper coating weights and crystal morphology are desirable in order to maximize corrosion protection.

The crystal morphology of the zinc phosphate coating is most preferably columnar or nodular, allowing for a heavier, denser coating on the metal surface to maximize corrosion protection and adhesion of subsequently applied paint coatings such as primers and top coats. Zinc phosphate coatings with a crystal morphology that has a platelet structure also can provide acceptable coatings when high coating coverage is achieved. On aluminum substrates the various coating compositions often yield coatings with less than complete coverage.

British Patent No. 2 226 829-A discloses a zinc phosphate conversion coating process wherein ferric iron (or ferrous iron plus an oxidizing agent) is added to control the free acid level in a zinc phosphate conversion coating composition to produce a zinc phosphate coating on the surface of zinc or aluminum alloy surfaces.

U.S. Pat. No. 4,865,653 discloses a zinc phosphate conversion coating process wherein hydroxylamine is used as an accelerator in a zinc phosphate conversion coating composition to produce a columnar or nodular crystal coating structure on the surface of cold-rolled steel. Also disclosed is the formation of coatings with platelet morphologies on aluminum. An additional discussion is presented on the use of hydroxylamine and ferrous ion in amounts up to the saturation point of the ferrous ion in the bath to expand the effective range of zinc ion in the composition.

It would be desirable to provide a zinc phosphate coating composition and process for forming a zinc phosphate coating having an appropriate coating weight and more complete coating coverage on an aluminum substrate so as to provide improved corrosion resistance for the coated aluminum substrate. Ideally, the zinc phosphate coating would form even in the absence of an accelerator and would have a columnar or nodular crystal morphology to enhance adhesion of subsequently applied paint to the coated aluminum substrate. A further object of the invention or at least one aspect of the invention would be a single concentrated treating solution with a reduced water content that can be diluted with water at the location of forming the zinc phosphate coating on substrates.

SUMMARY OF THE INVENTION

In accordance with the present invention, a process for forming a zinc phosphate conversion coating, a concentrate of the zinc phosphate coating composition, a pretreatment bath for the zinc phosphate conversion coating of aluminum, and the coated aluminum substrate are provided.

The process yields coated aluminum substrates with a coating weight of at least about 150 milligrams per square foot (mg/ft$^2$) which is equivalent to 1612 milligrams per square meter by contacting the aluminum substrate with the zinc phosphate conversion coating bath which contains: (a) from about 0.4 to 2.5 gram/liter (g/l) zinc ion; (b) from about 5 to 26 g/l phosphate ion; (c) from about 0.4 to 1.5 g/l fluoride ion; (d) from about 4 to 400 milligram/liter (mg/l) ferrous ion; and (e) from about 0.01 to 2 g/l ammonium ion. The zinc phosphate conversion coating can be formed on the aluminum substrate in the presence or absence of an accelerator.

The aqueous zinc phosphate conversion coating concentrate of the present invention contains: (a) from about 10 to 60 g/l zinc ion; (b) from about 125 to 500 g/l phosphate ion; (c) from about 2 to 40 g/l fluoride ion; (d) from about 0.1 to 10 g/l ferrous ion; and (e) from about 0.2 to 50 g/l ammonium ion. The concentrate may be diluted with an aqueous medium in a weight ratio of about 1:10 to 1:100 (concentrate to aqueous medium) to yield a zinc phosphate conversion coating solution, otherwise referred to as a pretreatment bath. The pretreatment bath may be contacted with the aluminum substrate by dipping or spraying usually at an elevated temperature for varying times depending on the application technique and processing equipment.

The zinc phosphate conversion coating pretreatment bath of the present invention is an aqueous solution comprising: (a) from about 0.4 to 2.5 g/l zinc ion; (b) from about 5 to 26 g/l phosphate ion; (c) from about 0.4 to 1.5 g/l of fluoride ion; (d) from about 4 to 400 mg/l ferrous ion; and (e) from about 0.01 to 2 g/l ammonium ion, wherein the source of fluoride ion is either ammonium bifluoride alone or with monofluoride and/or complex fluoride ions.

DETAILED DESCRIPTION

The zinc phosphate coating process of the present invention results in a complete or at least near complete coating of the aluminum substrate where the coating has crystals of zinc-iron phosphate. Such a coating is particularly useful on aluminum substrates in conjunction with cationically electrodeposited films to provide corrosion protection and paint adhesion. It is believed, without limiting the invention, that the coating predominantly has crystal types referred to as phosphophyllite [$FeZn_2(PO_4)_2$] and hopeite [$Zn_3(PO_4)_2$]. Thus, the present invention will hereinafter be referred to as "zinc-iron phosphate coating process and composition". The coating may be used with other subsequently applied films, such as epoxies, enamels and other paints. The solution of the present invention which directly contacts the aluminum substrate is referred to herein as "bath", which is at least an aqueous dilution of a concentrate, which can be one package or one self-contained solution except for the water of dilution. The term "bath" is not intended as a limitation of the manner of application of the zinc phosphate coating which generally can be applied to the aluminum substrate by various techniques. Nonexclusive examples of these application techniques are: immersion or dipping, involves placing the substrate into the bath; spraying; intermittent spraying; flow coating; and combined methods such as spraying-dipping-spraying, spraying-dipping, dipping-spraying, and the like.

Also, during the process of the present invention, after some period of initial operation of coating substrates, further high-quality phosphate coatings are achieved by an addition of a concentrate as a replenisher solution. The concentrate replenisher or modified versions of the concentrate replenisher overcomes the effects of continued operation of the process with the concomitant reduction in one or more ion concentrations. Such reductions are the result of ions: 1) removed from the bath through formation of the coating on the increasing quantity of metal processed through the bath, and/or 2) deposited or precipitated into any sludge formation. The replenisher allows the continued coating of the substrates while reducing any fluctuations in bath composition.

The zinc-iron phosphate coating bath of the present invention is aqueous and must be acidic. This bath, which contacts the aluminum substrates, generally has a pH of between about 2.5 to 5.5 and preferably between about 3.3 to 4.0. The pH, if lower than this range, can be adjusted to this range as necessary with any suitable basic solution as known to those skilled in the art; a 5 percent sodium hydroxide solution is suitable. The free acid content of the zinc phosphate coating bath is usually about 0.3 to 1.2. The free acid and total acid can be measured by any method known to those skilled in the art. One example is measurement by titration of a 10 milliliters (ml) sample with 0.1 Normal sodium hydroxide solution to a bromo-phenol blue end point. The low levels of the free acid in the bath can be maintained without loss of stability due to the presence of ferrous ion.

The zinc-iron phosphate coating bath of the present invention is a "lower zinc" coating bath as understood by those skilled in the art. The term "lower zinc" refers to baths wherein the zinc ion concentration includes the "low-zinc" levels and generally can be slightly higher than those of traditional low-zinc formulations that are from about 0.4 to around 2 g/l of zinc ion. In terms of the zinc ion concentration, levels as high as about 0.25 weight percent (2.5 g/l) are permissible, but platelet morphology may result even at zinc ion levels below 0.1 weight percent (1.0 g/l). For purposes of allowing a safety factor in controlling the process to obtain the desired morphology, a zinc ion level in the middle of the above-stated range should preferably be used, about 0.7 to 2.0 g/l.

The source of the zinc divalent cation may be one or more conventional zinc ion sources known in the art, such as zinc, zinc nitrate, zinc oxide, zinc carbonate, and even zinc phosphate, to the extent of solubility, and the like. With the use of the zinc phosphate, the quantitative range of the total acid is maintained by a reduced amount of phosphate ion from the other phosphate sources.

The phosphate ion content is usually between about 5 to 26 g/l, and preferably about 10 to 20 g/l. The source of phosphate ion may be any material or compound known to those skilled in the art to ionize in aqueous acidic solutions to form anions such as $(PO_4)^{-3}$ from simple compounds as well as condensed phosphoric acids including salts thereof. Ionization and neutralization of the phosphate ion sources may be to any degree, consistent with the present invention. Nonexclusive examples of such sources include: phosphoric acid, alkali metal phosphates such as monosodium phosphate, monopotassium phosphate, disodium phosphate, divalent metal phosphates and the like, as well as mixtures thereof. With the use of the divalent metal phosphates, the total phosphate or total acid as well as the divalent metal should involve control of the other sources of the phosphate and divalent metal, respectively, to obtain the desired quantities of each in the bath.

The aqueous acidic zinc-iron phosphate coating bath generally has a weight ratio of zinc ion to phosphate ion measured or calculated as $Zn:PO_4$ of 1:2 to 1:65, preferably about 1:5 to 1:30.

The zinc-iron phosphate coating bath of the present invention also contains fluoride ions present at about 0.4 to 1.5 g/l, preferably about 0.5 to 1.0 g/l, measured as the fluoride anion, $F^-$. The source of fluoride ion may be any fluoride-containing compound including monofluorides, bifluorides, fluoride complexes, and mixtures thereof known to generate fluoride ions. Examples include ammonium and alkali metal fluorides, acid fluorides, fluoroboric, fluorosilicic, fluorotitanic, and fluorozirconic acids and their ammonium and alkali metal salts, and other inorganic fluorides, nonexclusive examples of which are: calcium fluoride, zinc fluoride, zinc aluminum fluoride, titanium fluoride, zirconium fluoride, nickel fluoride, ammonium fluoride, sodium fluoride, potassium fluoride, and hydrofluoric acid, as well as other similar materials known to those skilled in the art.

The preferred source of fluoride ions may be any water-soluble bifluoride compound, preferably potassium bifluoride or more preferably ammonium bifluoride. Mixtures of bifluorides may also be used. The bifluorides may also be combined with monofluoride and/or complex fluoride ions. When such a combination is used, the monofluorides and/or complex fluoride ions are present in an amount of about 0.4 to 1.0 g/l, measured as $F^-$. Though not intending to be bound by any particular theory, it is believed that the bifluorides improve bath stability. In addition, the use of ammonium bifluoride yields smaller, more densely packed nodular or columnar coating crystals on the aluminum surface.

The zinc-iron phosphate coating bath of the present invention also contains iron ions, present as ferrous ions. The ferrous ion content of the zinc-iron phosphate coating bath is typically between about 4 to 400 mg/l or parts per million "ppm" and is preferably about 4 to 50 ppm. Less than 4 ppm ferrous ion will not allow a complete coating to form on the aluminum surface and greater than 400 ppm generally causes a precipitate to form in the bath. Though not intending to be bound by any theory, it is believed that the ferrous ions present in the coating bath become bound as a part of the final coating on the aluminum substrate being coated.

The source of the ferrous ion may be any water-soluble ferrous compound, such as ferrous sulfate ($FeSO_4.7H_2O$), which is preferred, ferrous chloride, ferrous nitrate, ferrous citrate, and mixtures thereof. The source of the ferrous ion may alternatively (or additionally) be iron or steel filings added to the bath or iron incidentally present in the bath etched from previously treated steel. Ordinarily, in the course of coating various types of substrates, including aluminum and iron-containing substrates like cold-rolled steel (CRS), the amount of ferrous ion in the bath from the coating of the iron-containing substrates needs to be supplemented for ferrous ion. With the addition of a source of ferrous ion, the production of zinc phosphate coating on aluminum can continue. The ferrous ions are preferably added to the coating bath at room temperature. If added to the bath at higher temperatures (i.e., standard coating process temperatures of about 90° F. to 160° F. (32° C. to 71° C.)), the free acid level of the coating bath may need to be lowered by the addition of sodium carbonate, sodium hydroxide, or a buffer.

The zinc-iron phosphate coating bath of the present invention also contains ammonium ions, which yield coatings with columnar or nodular crystal morphology. The ammonium ion content of the zinc-iron phosphate coating bath is typically between about 0.01 to 2 g/l and is preferably about 0.05 to 1 g/l. The source of the ammonium ion may be any water-soluble ammonium compound, such as ammonium bifluoride, which is preferred, ammonium phosphate, and the like. Also, ammonium compounds that are sources for anions to the bath may be used to contribute to the total quantity of the ammonium ion and these include the following examples: ammonium fluorides; accelerators like: ammonium nitrite, ammonium chlorate, and ammonium nitrate, however, such accelerators may oxidize ferrous ions present in the composition, preventing the formation of desired crystal structures on a coated substrate. The use of the accelerators should be judicious to avoid the oxidation of the ferrous ion. Also, compounds with groups convertible to ammonium groups as are known to those skilled in the art are also suitable. For instance, compounds added to adjust the pH of the bath or concentrate like ammonium hydroxide and/or ammonium acid salts of mono-, di-, and triethanolamine can be used. Also compounds, such as an ammonium salt of zirconium hydroxy carbonate, zirconium acetate or zirconium oxalate, can be used as well as the hydroxylamine source such as a hydroxylamine salt or complex, which frequently exist in a hydrated form and hydroxylamine sulfate ("HAS"), a stable salt of hydroxylamine. HAS is also referred to as hydroxyl-ammonium sulfate. HAS may be represented by the formulae $(NH_2OH)_2 \times H_2SO_4$ or $(NH_3OH)_2 \times SO_4$.

In addition to the zinc ion, phosphate ion, fluoride ion, ferrous ion, and ammonium ion, the aqueous acidic zinc-iron phosphate bath may contain nitrate ion and various metal ions, such as nickel ion, cobalt ion, calcium ion, manganese ion, tungsten ion, and the like. The nitrate ion may be present in an amount of about 1 to 10 g/l, preferably between about 2 to 5 g/l. When present, nickel or cobalt ion is generally each in a separate amount of about 0.2 to 1.2 g/l, preferably between about 0.3 to 0.8 g/l. Calcium ion may be present but should not exceed 2.5 g/l, or 2500 ppm, to limit the risk of precipitation. In general, this is the case for any hard water salts that may be present. Manganese ion may be present in an amount of about 0.2 to 1.5 g/l, preferably between about 0.7 to 1.2 g/l. Also, tungsten may be present in an amount of about 0.01 to 0.5 g/l, preferably between about 0.02 to 0.2 g/l.

Conventional nitrite and/or chlorate accelerators, such as sodium nitrite, ammonium nitrite, sodium chlorate, and ammonium chlorate, may be added to the zinc-iron phosphate coating bath. However, as mentioned above, their presence is not required but is optional and when used their levels should not exceed 0.5 g/l nitrite ion or chlorate ion in order to avoid oxidation of the ferrous ion to ferric ion. Typically, the level of nitrite ion is between about 0.04 and 0.2 g/l. Other types of accelerators known to those skilled in the art may also be used in the zinc-iron phosphate coating bath. Typical accelerators include: sodium nitrobenzene sulfonates, particularly m-sodium nitrobenzene sulfonate, ammonium nitrobenzene sulfonates, sodium chlorate, potassium chlorate, ammonium chlorate, and hydroxylamines, oximes like acetaldehyde oxime, and hydrogen peroxide. These additional accelerators, when used, are present in amounts of from about 0.05 to 20 g/l.

The amounts of the various ions added to the coating bath may be determined theoretically before preparation thereof or they may be subsequently measured analytically by techniques known to those skilled in the art and adjusted accordingly. The specific amounts of each ion and ratios among ions, within the ranges which have been set forth above, will be determined for each particular coating operation as is well known in the art.

The zinc-iron phosphate coating bath of the present invention can be prepared fresh with the above-mentioned ingredients in the concentrations specified or can be prepared from aqueous concentrates in accordance with the present invention in which the concentration of the various ingredients is considerably higher. Concentrates are advantageous in that they may be prepared beforehand and shipped to the application site where they are diluted with an aqueous medium, such as water, or a zinc phosphating composition which has been in use for some time. Concentrates are also a practical way of replacing the active ingredients as a replenishing solution. A zinc-iron phosphate coating "make-up" concentrate of the present invention contains ingredients in amounts (in grams per liter) as shown in the ranges of amounts of Table A.

TABLE A

| | Amounts | Preferred Amounts |
|---|---|---|
| Ions | | |
| zinc | 10 to 60 | 17 to 50 |
| phosphate | 125 to 500 | 150 to 300 |
| fluoride | 2 to 40 | 10 to 25 |
| ferrous[1] | 0.1 to 10 | 0.2 to 2 |
| ammonium | 0.2 to 50 | 1 to 25 |
| Optional Ions: | | |
| manganese | 5 to 40 | 14 to 30 |
| nickel | 5 to 30 | 7 to 20 |
| nitrate | 25 to 250 | 50 to 125 |
| Other ions[2] | up to 250 | 25 to 100 |

[1]The ferrous ion may be added directly to the concentrate before dilution thereof without precipitation occurring.
[2]Cobalt, calcium and tungsten and other metal ions known to those skilled in the art as well as additional accelerators such as those described previously can also be present.

Unless otherwise noted, the sources of the various ions present in the concentrate may be the same as those used to prepare a bath as noted previously.

To prepare a zinc-iron phosphate coating bath in accordance with the present invention, the concentrate of the present invention may be diluted with aqueous medium in a weight ratio of about 1:10 to 1:100, preferably about 1:20 to 1:50, depending on the aqueous medium used for dilution and the amounts of various ingredients required in the final coating bath. Also, a concentrate may be added to a bath as a replenishing solution as mentioned above in a calculated amount as known to those skilled in the art of adding replenisher solutions to phosphate conversion coating baths.

The initial working bath solutions may be formulated with the component amounts and weight ratios as have been set forth above. Since the ion components of the acidic aqueous bath are present in a narrow range for deposition by chemical reaction on the substrate, the baths after a period of operation may be replenished with one or more concentrates as a replenisher. The replenisher is added to maintain the amounts and ratios of the necessary components of the bath at the desired operating levels. With use of the bath and make-up concentrate as the replenisher concentrate, the bath can become enriched with some ions which are less prevalent in the coating on the substrate leaving the bath. Usually, the bath is enriched with nickel relative to zinc, and the iron and fluoride ion concentration will decrease in the bath. With this in mind, it is preferred that when a concentrate is used as a replenisher, a replenisher formulation is modified from the formulation of the make-up concentrate that was diluted to form the bath. Preferably replenisher has ion concentrations that are higher than the make-up concentrate by the following factors for the specified ions: zinc around 2.1; manganese around 1.1; phosphate around 1.5; ferrous and fluoride each around 1.5 where all factors are times (multiplied by) those ion concentrations in the make-up concentrate. The amount of nickel preferably is 1.8 times less than that of the make-up concentrate.

The addition of the replenisher can be done by any method known in the art, for instance through quantitative testing for the concentration of one or more ions that will decrease in value with the operation of the bath. An example is to test for the fluoride ion, free acid and/or the total acid and when the values for one or more of these decrease below the minimum values for the operation of the bath, the replenisher is added. With the addition, one or more tested quantities are returned above the minimum of the range for the operation of the bath.

The zinc-iron phosphate coating bath is typically used to coat aluminum substrates but can be used to coat other metal substrates including substrates containing more than one metal, such as automobile bodies which besides aluminum contain steel and zinc metal; i.e., galvanized steel. When ferrous metals are present in and/or on the substrates that are treated, an accelerator like the aforementioned should be present in the zinc-iron phosphate conversion coating bath.

The contact time of the bath with a metal substrate will be within the range of times customary for the particular contacting procedure used. Typically, for spray contact, these will be from about 0.5 to 3 minutes (30 to 180 seconds); from about 1 to 5 minutes for immersion processes; and about 20 seconds spraying and 2 minutes immersion for a combined spray-immersion process.

Typically, in these operations, the bath temperature will be within the range of about 90° F. to 160° F. (32° C. to 71° C.) and preferably at temperatures of between about 120° F. to 135° F. (49° C. to 57° C.)

The resulting coating on the substrate is more continuous and uniform with a crystalline structure which is preferably columnar or nodular, as can be observed with a scanning electron microscope by standardized procedures known in the art. The columnar crystalline structure resembles small column-shaped crystals, and the nodular morphology resembles uniformly dispersed small nodular or round-shaped crystals. The coating weight generated can be between about 150 to 400 mg/ft$^2$ (1612 to 4300 milligrams per square meter), preferably about 200 to about 350 mg/ft$^2$ (2150 to 3768 mg/m$^2$) and most preferably 250 to 350 mg/ft$^2$ (2690 to 3768 mg/m$^2$). These coating weights can be determined by gravimetric testing by standardized procedures known in the art.

It will also be appreciated that certain other steps may be done both prior to and after the application of the coating by the process of the present invention. For example, the substrate being coated is preferably first cleaned to remove grease, dirt, or other extraneous matter. This is usually done by employing conventional cleaning procedures and materials. These would include, for example, mild or strong alkali cleaners, acidic cleaners, and the like. Such cleaners are generally followed by a water rinse as is known by those skilled in the art.

It is preferred to employ a conditioning step following, or as part of, the cleaning step, such as disclosed in U.S. Pat. Nos. 2,874,081; 2,884,351 and 3,310,239. The conditioning step involves application of a condensed titanium phosphate solution to the metal substrate. The conditioning step provides nucleation sites on the surface of the metal substrate resulting in the formation of a densely packed crystalline coating which enhances performance.

After the zinc phosphate conversion coating is formed and water rinsed, it is advantageous to subject the coating to a post-treatment rinse to seal the coating and improve performance. The rinse composition may contain chromium (trivalent and/or hexavalent) or may be chromium-free as is well known to those skilled in the art as shown, for example, in U.S. Pat. Nos. 3,450,579; 4,180,406 and 4,457,790, respectively.

The invention will be further described by reference to the following examples. Unless otherwise indicated, all amounts are parts by weight of the total aqueous acidic zinc phosphating formulation unless the amounts are specifically listed in other units.

EXAMPLES A TO E

Examples A to E illustrate the effects of ferrous ion added to a zinc phosphating bath at increasing levels. The bath in Example A contains no ferrous ion; Example B contains 20 mg/l $FeSO_4.7H_2O$ (4 mg/l $Fe^{++}$); Example C contains 250 mg/l $FeSO_4.7H_2O$ (50 mg/l $Fe^{++}$); Example D contains 2000 mg/l $FeSO_4.7H_2O$ (400 mg/l $Fe^{++}$); and Example E contains 5000 mg/l $FeSO_4.7H_2O$ (1000 mg/l $Fe^{++}$).

Aqueous acidic zinc phosphate concentrates were prepared from the ingredients listed in Table I below, mixed at room temperature:

TABLE I

| | Examples | | | | | | Examples |
|---|---|---|---|---|---|---|---|
| INGREDIENTS: | A | B | C | D | E | Ions | A–E |
| Water | 59.21 | 59.21 | 59.21 | 59.21 | 59.21 | | |
| $H_3PO_4$ (75%)[2] | 22.51 | 22.51 | 22.51 | 22.51 | 22.51 | $PO_4$ | 201 |
| $HNO_3$ (66%)[2] | 1.88 | 1.88 | 1.88 | 1.88 | 1.88 | $NO_3$ | 15 |
| ZnO | 2.41 | 2.41 | 2.41 | 2.41 | 2.41 | Zn | 23.3 |
| MnO | 2.61 | 2.61 | 2.61 | 2.61 | 2.61 | Mn | 24.5 |
| $Ni(NO_3)_2$ (43%)[2] | 5.93 | 5.93 | 5.93 | 5.93 | 5.93 | Ni | 10.2 |
| | | | | | | $(NO_3)_2$ | 20.9 |
| KF (40%)[2]/ | 2.85/ | 2.85/ | 2.85/ | 2.85/ | 2.85/ | F | 3.7/ |
| KFHF | 2.4 | 2.4 | 2.4 | 2.4 | 2.4 | | 14.7 |
| Acetaldehyde Oxime | 0.2 | 0.2 | 0.2 | 0.2 | 0.2 | | |
| $FeSO_4.7H_2O$[1] (ppm) | 0 | 20 | 250 | 2000 | 5000 | | |

[1]Measured as ppm ferrous sulfate($FeSO_4.7H_2O$) in bath after dilution of concentrate.
[2]The $H_3PO_4$, $HNO_3$, $Ni(NO_3)_2$, and KF ingredients were present in separate aqueous solutions in the concentrations indicated by percent by weight of the solution.

In the last two columns on the right of Table I, there are shown the concentrations for the listed ions in grams per liter in the concentrate from the addition of the parts by weight of the listed ingredient.

Each concentrate was diluted with water in a weight ratio of concentrate to water of about 1 to 20 to form the zinc phosphating bath, and, if added, the ferrous sulfate was added to the bath. Aluminum test panels were subjected to the following treatment process in Examples A to E.

(a) degreasing: the test panels were first cleaned using an alkaline degreasing agent ("CHEMKLEEN™ 163", available from PPG Industries, Inc., at 1% by weight) which was sprayed onto the metal substrates at 131° F. (55° C.) for one minute;

(b) rinsing: the test panels were then rinsed with tap water at room temperature for 15 to 30 seconds;

(c) conditioning: the rinsed test panels were then dipped into a surface conditioner ("PPG Rinse Conditioner", available from PPG Industries, Inc., at 0.1% by weight) at room temperature for one minute; followed by:

(d) phosphating: in which the test panels were dipped into acidic aqueous compositions 1/20th of the values given in the table above at 120° F. to 135° F. (49° C. to 57° C.) for two minutes;

(e) rinsing: the coated test panels were then rinsed with tap water at room temperature for 15 seconds.

RESULTS FOR TABLE I

| RESULTS: | A | B | C | D | E |
|---|---|---|---|---|---|
| Morphology[1] | P[2] | P | P | P | P |
| Crystal Size (microns) | 25 | 20–50 | 10–20 | 10–20 | 20–50 |

[1]Morphology was determined by Scanning Electron Microscopy. Crystal type may vary depending on the zinc phosphate coating composition and the substrate. Nodular crystals are indicated as an "N", platelet crystals as a "P" and columnar crystals as a "C". This nomenclature also applies to examples in subsequent tables.
[2]Powdery appearance; coating could easily be rubbed off substrate.

The results for Table I are reported in the table entitled "Results for Table I" and indicate that when no ferrous ion is present in the bath, the coating that is formed is not viable; i.e., it is easily rubbed off the substrate. Addition of ferrous ion at levels of 20–5000 ppm $FeSO_4.7H_2O$ yields a complete and viable coating.

EXAMPLE F (COMPARATIVE)

Example F illustrates the effects of an accelerator added to a zinc phosphating bath. An aqueous acidic zinc phosphate bath was prepared as in Example C of Table I above, with the addition of a sodium nitrite accelerator at 280 mg/l nitrite concentration. Aluminum test panels were subjected to the same treatment process as in Examples A to E. The results are reported in Table II below.

TABLE II

| Example: | C | F |
|---|---|---|
| Morphology | P | P |
| Crystal Size, (microns) | 10–20 | 10–20 |

The data in Table II indicate that aluminum substrates can be coated with zinc phosphate coating compositions containing ferrous ion with or without a nitrite accelerator.

EXAMPLES G AND H

Examples G and H compare the effects of ferrous iron and ferric iron added to a zinc phosphating bath. Aqueous acidic zinc phosphate concentrates were prepared and diluted from the following mixture of ingredients listed in Table III, mixed at room temperature:

TABLE III (Part 1)

| INGREDIENTS: | Examples G | Examples H | Ions | Examples G | Examples H |
|---|---|---|---|---|---|
| Water (in concentrate) | 61.94 | 61.94 | | | |
| $H_3PO_4$ (75%) | 22.51 | 22.51 | $PO_4$ | 200 | 200 |
| $HNO_3$ (66%) | 1.88 | 1.88 | $NO_3$ | 15.2 | 15.2 |
| ZnO | 2.41 | 2.41 | Zn | 23.5 | 23.5 |
| MnO | 2.61 | 2.61 | Mn | 24.7 | 24.7 |
| $Ni(NO_3)_2$ (43%) | 5.93 | 5.93 | Ni | 10 | 10 |
| | | | $NO_3$ | 21 | 21 |
| $NH_4FHF$ | 2.27 | 2.27 | F | 18 | 18 |
| | | | $NH_4$ | 9.4 | 9.4 |
| $FeSO_4.7H_2O$ | 0.25 | 0 | Ferrous | 0.6 | 0 |
| $Fe_2(SO_4)_3$ | 0 | 0.25 | Ferric | 0 | 0.6 |

(Part 2) Results

| RESULTS: | Examples G | Examples H |
|---|---|---|
| Coating weight, ($mg/m^2$) | 3768 | 3229 |
| Crystal Size, (microns) | 10–20 | 50–100 |

Again, in the last three columns on the right of Part 1 of Table III, there are shown the concentrations for the listed ions in grams per liter in the concentrate from the addition of the parts by weight of the listed ingredients.

Each of the concentrates listed in Part 1 of Table III was diluted with water in a weight ratio of 4.2 parts concentrate to 95.8 parts water (1:22.8). The bath containing ferric ions was cloudy and formed a precipitate of ferric phosphate. Aluminum test panels were subjected to the same treatment process as in Examples A to E. The results are reported in Part 2 of Table III above under the heading "Results" for the appropriate example.

The data in Table III indicate that higher coating weights can be achieved with baths containing ferrous ions' than with baths containing ferric ions. Moreover, the crystal size in the resultant coatings is much smaller for baths containing ferrous ions than for those containing ferric ions.

EXAMPLES I TO K

Examples I to K compare the effects of various monofluorides and bifluorides added to a zinc phosphating bath. The bath prepared in Example I contains potassium bifluoride; the bath prepared in Example J contains ammonium bifluoride; and the bath prepared in Example K contains a mixture of potassium fluoride and potassium bifluoride. Aqueous acidic zinc phosphate concentrates were prepared from the following mixture of ingredients of Table IV, mixed at room temperature:

TABLE IV

| | Examples | | | | Examples | | |
|---|---|---|---|---|---|---|---|
| | I | J | K | Ions | I | J | K |
| IN-GREDIENTS: | | | | | | | |
| Water (in concentrate) | 61.15 | 61.94 | 58.96 | | | | |
| $H_3PO_4$ (75%) | 22.51 | 22.51 | 22.51 | $PO_4$ | 200 | 200 | 200 |
| $HNO_3$ (66%) | 1.88 | 1.88 | 1.88 | $NO_3$ | 15.2 | 15.2 | 15.2 |
| ZnO | 2.41 | 2.41 | 2.41 | Zn | 23.5 | 23.5 | 23.5 |
| MnO | 2.61 | 2.61 | 2.61 | Mn | 24.7 | 24.7 | 24.7 |
| $Ni(NO_3)_2$ (43%) | 5.93 | 5.93 | 5.93 | Ni | 10 | 10 | 10 |
| | | | | $NO_3$ | 21 | 21 | 21 |
| KF (40%) | — | — | 2.85 | F | 0 | 4.6 | |
| KFHF | 3.06 | — | 2.4 | F | 18 | 0 | 14 |
| $FeSO_4.7H_2O$ | 0.25 | 0.25 | 0.25 | $Fe_{++}$[1] | 0.6 | 0.6 | 0.6 |
| $NH_4FHF$ | — | 2.27 | — | F | 0 | 18 | 0 |
| | | | | $NH_4$ | 0 | 9.4 | 0 |
| Acetaldehyde Oxime | 0.2 | 0.2 | 0.2 | | | | |
| RESULTS: | | | | | | | |
| Morphology | P | N | P | | | | |
| Crystal Size, (microns) | 2050 | <10 | 20–50 | | | | |

[1]$Fe_{++}$ indicates ferrous ion.

As in Tables I and III in the last four columns on the right of Table IV, there are shown the concentrations for the listed ions in grams per liter in the concentrate from the addition of the parts by weight of the listed ingredients.

Each of the aforelisted concentrates was diluted with water in a weight ratio of 4.2 parts concentrate to 95.8 parts water (1:22.8) to form the zinc phosphating bath. Aluminum test panels were subjected to the same treatment process as in Examples A to E. The results are reported in Table IV under the "Results" heading. The data from the Results in Table IV indicate that ammonium bifluoride rather than potassium bifluoride will yield a nodular morphology with smaller crystal sizes.

EXAMPLE L

Example L illustrates the effect of introducing ferrous iron to the bath via previous treatment of cold-rolled steel. An aqueous acidic zinc phosphate concentrate was prepared and diluted from the following mixture of ingredients listed in Table V below, mixed at room temperature:

TAELE V

| INGREDIENTS: | Example L | Ions | Example L |
|---|---|---|---|
| Water | 59.21 | | |
| $H_3PO_4$ (75%) | 22.51 | $PO_4$ | 201 |
| $HNO_3$ (66%) | 1.88 | $NO_3$ | 15 |
| ZnO | 2.41 | Zn | 23.5 |
| MnO | 2.61 | Mn | 24.7 |
| $Ni(NO_3)_2$ (43%) | 5.93 | Ni | 10 |
| | | $NO_3$ | 21 |
| KF (40%) | 2.85 | F | 4.6 |
| KFHF | 2.4 | F | 14 |
| Acetaldehyde Oxime | 0.2 | | |

RESULTS FOR TABLE V

| RESULTS: | Example L |
|---|---|
| Morphology | P |
| Crystal Size, (microns) | 50–100 |

Again, in the last two columns on the right of Table V, there are shown the concentrations for the listed ions in grams per liter in the concentrate from the addition of the parts by weight of the listed ingredient.

The aforelisted concentrate was diluted with water in a weight ratio of concentrate to water of about 1 to 22.8 to form 300 ml (milliliters) of the zinc phosphating bath. Three 0.5"×2" (1.27 cm×5.08 cm), where (") indicates "inches", aluminum panels were processed in the bath at 125° F. (52° C.) for two minutes with no coating being formed. Then two 0.5"×4" (1.27 cm×10.16 cm) cold-rolled steel panels were processed in the bath at 125° F. (52° C.) for two hours, followed by processing of two more 0.5"×2" (1.27 cm×5.08 cm) aluminum panels in the bath at 125° F. (52° C.) for two minutes. The average properties of coatings formed on the last two aluminum panels are reported in Table V above under the "Results" heading. The data in Table V indicate that a ferrous ion can be incorporated into a zinc phosphating bath via processing of cold-rolled steel to yield coatings on subsequently processed aluminum substrates.

I claim:

1. A process for forming a zinc phosphate coating having a coating weight of at least about 150 milligrams/foot$^2$ (1612 milligrams/meter$^2$) on an aluminum substrate, comprising contacting said aluminum substrate with a zinc phosphate conversion coating bath which contains: (a) from about 0.4 to 2.5 g/l zinc ion; (b) from about 5 to 26 g/l phosphate ion; (c) from about 0.4 to 1.5 g/l of fluoride ion; (d) from about 4 to 400 mg/l ferrous ion; and (e) from about 0.01 to 2 g/l ammonium ion, wherein fluoride ion is provided from ammonium bifluoride which also acts as a source of ammonium ions and wherein said zinc phosphate coating is formed on the aluminum substrate optionally in the presence of an accelerator.

2. The process of claim 1 wherein in addition to providing fluoride ion from ammonium bifluoride, the fluoride ion is also provided from materials selected from the group consisting of monofluorides, complex fluoride ions, and mixtures thereof.

3. The process of claim 1 in which the zinc phosphate coating has a columnar or nodular crystal morphology.

4. The process of claim 1 in which the aluminum substrate is contacted with the zinc phosphate conversion coating bath at a bath temperature of about 90° F. to 160° F. (32° C. to 71° C.).

5. The process of claim 1 in which the aluminum substrate is contacted with the zinc phosphate conversion coating bath by spraying or immersion.

6. The process of claim 1 in which the source of ferrous ion is selected from the group consisting of ferrous sulfate, ferrous chloride, ferrous nitrate, ferrous citrate, iron, steel, and mixtures thereof.

7. The process of claim 1 in which the bath contains from about 0.7 to 2.0 g/l zinc ions; from about 10 to 20 g/l phosphate ions; from about 0.5 to 1.0 g/l fluoride ion; from about 4 to 50 mg/l ferrous ion; and from about 0.05 to 1 g/l ammonium ions.

8. The process of claim 1 in which the bath further contains an accelerator selected from the group consisting of nitrite ion in an amount of about 0.04 to 0.2 g/l and oxime present in an amount from about 0.05 to 20 g/l.

9. The process of claim 1 in which the bath further contains: at least one ion selected from the group consisting of: nickel ion, cobalt ion, calcium ion, manganese ion, tungsten ion, nitrate ion, and mixtures thereof; wherein when present the ions are in amounts in the range of:

about 0.2 to 1.2 g/l of nickel ion;

about 0.2 to 1.2 g/l of cobalt ion;

up to about 2.5 g/l of calcium ion;

about 0.2 to 1.5 g/l of manganese ion;

about 0.01 to 0.5 g/l of tungsten ion; and about 0.25 to 10 g/l of nitrate ion.

10. The process of claim 1 in which the coating weight of the zinc phosphate coating is from about 250 to 400 $mg/ft^2$ (2690–4307 $mg/m^2$).

11. The process of claim 1 wherein the bath has a weight ratio of zinc ion to phosphate ion measured or calculated as $Zn:PO_4$ of 1:2 to 1:65.

12. An aluminum substrate coated in accordance with the process of claim 1.

* * * * *